United States Patent [19]

Williams

[11] 4,196,860

[45] Apr. 8, 1980

[54] PULVERIZING AND CLASSIFYING APPARATUS WITH IMPROVED TAILINGS AND CONTAMINANT TAKE-OUT CONTROL

[75] Inventor: Norman E. Williams, Coon Rapids, Minn.

[73] Assignee: Bepex Corporation, Santa Rosa, Calif.

[21] Appl. No.: 948,490

[22] Filed: Oct. 4, 1978

Related U.S. Application Data

[63] Continuation of Ser. No. 822,725, Aug. 8, 1977, abandoned.

[51] Int. Cl.[2] ..... B02C 23/34; B02C 23/32; B02C 23/24

[52] U.S. Cl. ..... 241/52; 241/79; 241/80

[58] Field of Search ..... 241/5, 40, 52, 79, 79.1, 241/80, 275

[56] References Cited

U.S. PATENT DOCUMENTS

| | | | |
|---|---|---|---|
| 910,196 | 1/1909 | Hess | 241/80 |
| 2,939,638 | 6/1960 | Haigh et al. | 241/52 |
| 3,038,672 | 6/1962 | Langsetmo et al. | 241/52 X |
| 3,688,991 | 9/1972 | Andrews | 241/5 |

*Primary Examiner*—Richard B. Lazarus

*Attorney, Agent, or Firm*—McDougall, Hersh & Scott

[57] ABSTRACT

A horizontal axis pulverizing and classifying apparatus characterized by a plurality of gas flow passages in a narrow band surrounding the classification zone and directed generally radially inward, and means for selectively and variably introducing gas to those passages. The apparatus may also be fitted with special means for removing contaminating particles which reduce the capacity and efficiency of such apparatus. The take-out device is a porous tubular duct communicating with the classification zone of the apparatus through the housing wall. The porous tubular duct is surrounded by a non-porous tubular casing forming an annulus connected to a source of gas under pressure. Control over the quantities of tailings recycled and over quantities of contaminants removed is exercised by varying the amount and pressure of gas introduced through the gas flow passages.

8 Claims, 6 Drawing Figures

30
46
16
42
43
44
43
10
24
32
2
29
45
45
25
31
2
28
46
44
11

20
16
15
22
12
10
30
17
45
18
19
23
21
14
24
45
32
1
1
29
42
28
26
13
31
27
25

PULVERIZING AND CLASSIFYING APPARATUS WITH IMPROVED TAILINGS AND CONTAMINANT TAKE-OUT CONTROL

This is a continuation of application Ser. No. 822,725, filed Aug. 8, 1977, now abandoned.

BACKGROUND OF THE INVENTION

This invention is directed to pulverizing and classifying apparatus of the type in which material such as limestone to be reduced in size is introduced into one end of a cylindrical housing or casing and, by action of the horizontal axis pulverizing and classifying rotors therein, is progressively reduced in size. In the classifying zone of the apparatus, particles of the desired size and finer are removed. The pulverizer-classifier of U.S. Pat. No. 3,038,672 is exemplary of such apparatus.

It is common practice to remove coarse, over-size and agglomerated particles from the classifying zone and recycle them as tailings for further reduction. It is undesirable to permit over-sized particles to be discharged with the desired fine particle material Such particles are regarded as contaminants which lower the quality of the product. It is equally undesirable to recycle any appreciable quantity of fine particles as this reduces the capacity and efficiency of the apparatus. Accordingly, close control over the nature and quantity of tailings material to be recycled is necessary for maximum utilization of the apparatus and efficient production of high quality ground products.

It is also well known that a small percentage of hard abrasive contaminant can greatly reduce the capacity of the pulverizing apparatus. Such contaminants also make it more difficult to meet fine grinding specifications where all of the fine particles are desired to be of as uniform a size as possible. This is especially true if the contaminant is somewhat harder than the product being ground. In some cases, the product such as limestone is not contaminated by foreign substances but in its natural state has a small percentage of extra-hard particles in it, such as alumina or magnesia scale. In either case, since these particles are harder to reduce in size, they will tend to continuously recycle in the tailings return. As more and more of these harder over-size particles are recycled, the capacity and efficiency of the apparatus is reduced. Any portion of these particles which escape with the fine product may tend to be coarser than the rest of the product and make it difficult to hold fineness specifications. Generally these harder particles are more abrasive and in many cases the majority of the internal wear of the apparatus is caused by this small fraction of extra hard material. The contaminants may also be particles which are darker or otherwise different in color from the desired product such that it is preferable that they be removed. The present invention is directed toward alleviation of these problems.

SUMMARY OF THE INVENTION

Broadly stated, the invention is directed to an improvement in a pulverizing and classifying apparatus having a cylindrical housing with inlet and discharge means adjacent its opposite ends, rotary horizontal axis pulverizing means within the housing adjacent the inlet end and coaxial rotary classifying means within the housing adjacent the discharge end, and port means through the housing adjacent the classifying end for withdrawing tailings for recycling. The improvement resides in a gas flow control ring which comprises a plurality of gas jets or other gas flow passages closely spaced apart around the inner periphery of the cylindrical apparatus housing adjacent the classifying means. Each of the gas jets or other passages communicates with a gas duct which in turn communicates with a gas inlet through the cylindrical apparatus housing wall. Preferably a plurality of gas ducts are provided, each with its own gas inlet such that the gas passages around a given fraction of the periphery of the apparatus housing can be independently pressurized.

As used herein, the term "contaminant" refers to particles which are coarser or harder than the desired product or different in color from the desired product. Such particles may be abrasive particles present as foreign contaminants or may be merely the natural state of a portion of the material to be pulverized. The term "contaminant" includes but is not limited to harsh, rough refractory type materials.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
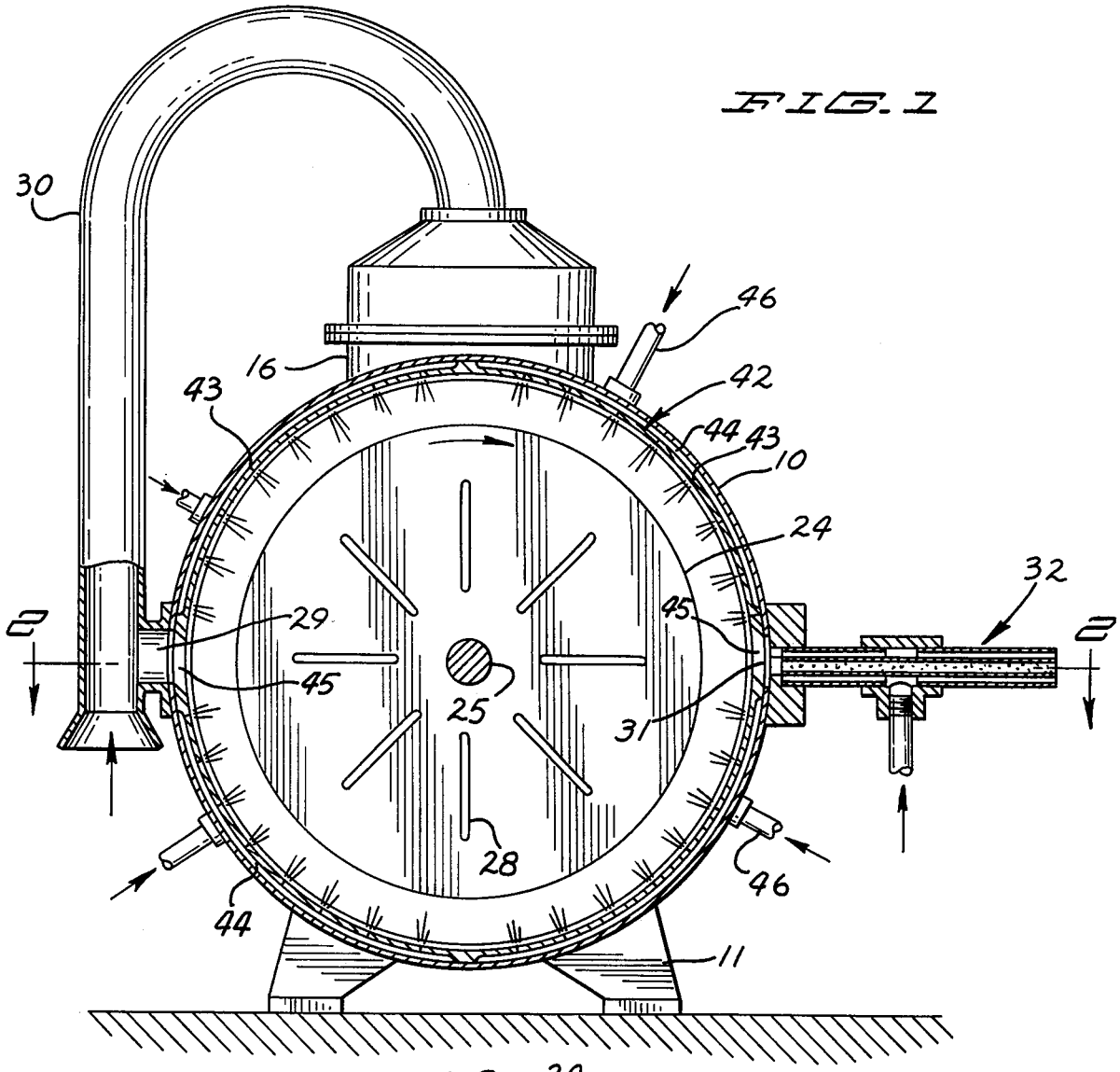
FIG. 1 is an elevation, partly in section, of a pulverizing and classifying apparatus embodying the invention.
Figure 2:
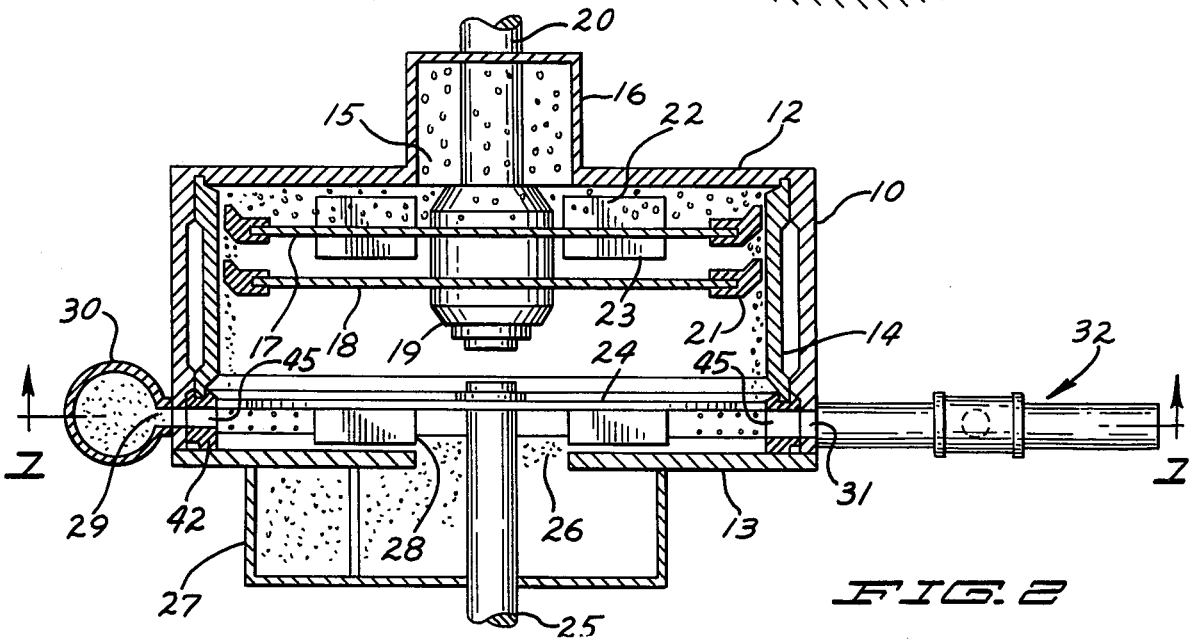
FIG. 2 is a horizontal section on the line 2—2 of FIG. 1 and in the direction of the arrows.

Referring to the drawings, and particularly FIGS. 1 and 2, the apparatus of this invention comprises a cylindrical housing 10 supported for example on feet or legs 1. The housing has end walls 12 and 13 and, as shown, preferably has a removable liner 14 which is replaceable when worn. End wall 12 has an inlet opening 15 located in the central portion thereof. Inlet 15 communicates with a hopper 16 through which material to be ground is fed and through which tailings are recycled for further reduction.

A pulverizing rotor is mounted for rotation within the housing adjacent the feed inlet. The rotor comprises one or more discs or circular beater plates 17 and 18 mounted on hub 19 on shaft 20. Each beater plate carries a plurality of spaced beaters 21 mounted on the peripheral edges thereof. Beater plate 17 closest to the feed inlet carries a plurality of radiating primary beater vanes or angles 22 spaced radially inwardly from the beaters 21 and mounted on the feed inlet side of the plate. The edges of beater vanes 22 are closely spaced from end wall 12 and in cooperation therewith perform a primary size reduction of the material to be ground. The opposite side of beater plate 17 carries a plurality of similar secondary beater vanes or angles 23 which serve to balance the beater plate and to assist in performing the pulverizing function in conjunction with the next adjacent beater plate 18.

A classifier disc 24 is mounted on coaxial shaft 25 which extends through an outlet or discharge aperture 26 in end wall 13. Aperture 26 communicates directly with a scroll housing 27 for removal of the desired pulverized product. A plurality of radial classifying vanes 28 are mounted on the discharge side of disc 24.

Housing 10 is provided with a tailings port or aperture 29 adjacent the periphery of classifier disc 24 in the classifying zone for withdrawal of tailings, those particles not reduced to the desired particle size. These tailings are withdrawn through aperture 29 and may be recycled through duct 30 for further pulverizing.

The basic structure of the apparatus described to this point and its basic mode of operation in reducing material to be ground and in classifying the reduced particles are generally the same as those of the aforesaid U.S. Pat. No. 3,038,672, which is incorporated herein by reference.

The housing 10 may optionally be provided with a contaminant take-out port or aperture 31 located adjacent to the periphery of classifier disc 24 and spaced peripherally around the housing from the tailings aperture, preferably 180° apart, diametrically opposed, as shown. An abrasives take-out device, indicated generally at 32, is secured to the outer housing wall to project substantially radially outwardly therefrom and in direct communication with aperture 31. The take-out device 32 comprises a T-fitting in whose opposite ends are fitted pipe segments which together form a tubular housing. An inner concentric porous tube is positioned within the tubular housing. The contaminant take-out device is shown and described in my copending application Ser. No. 822,721 of even filing date herewith and now abandoned.

Figure 3:
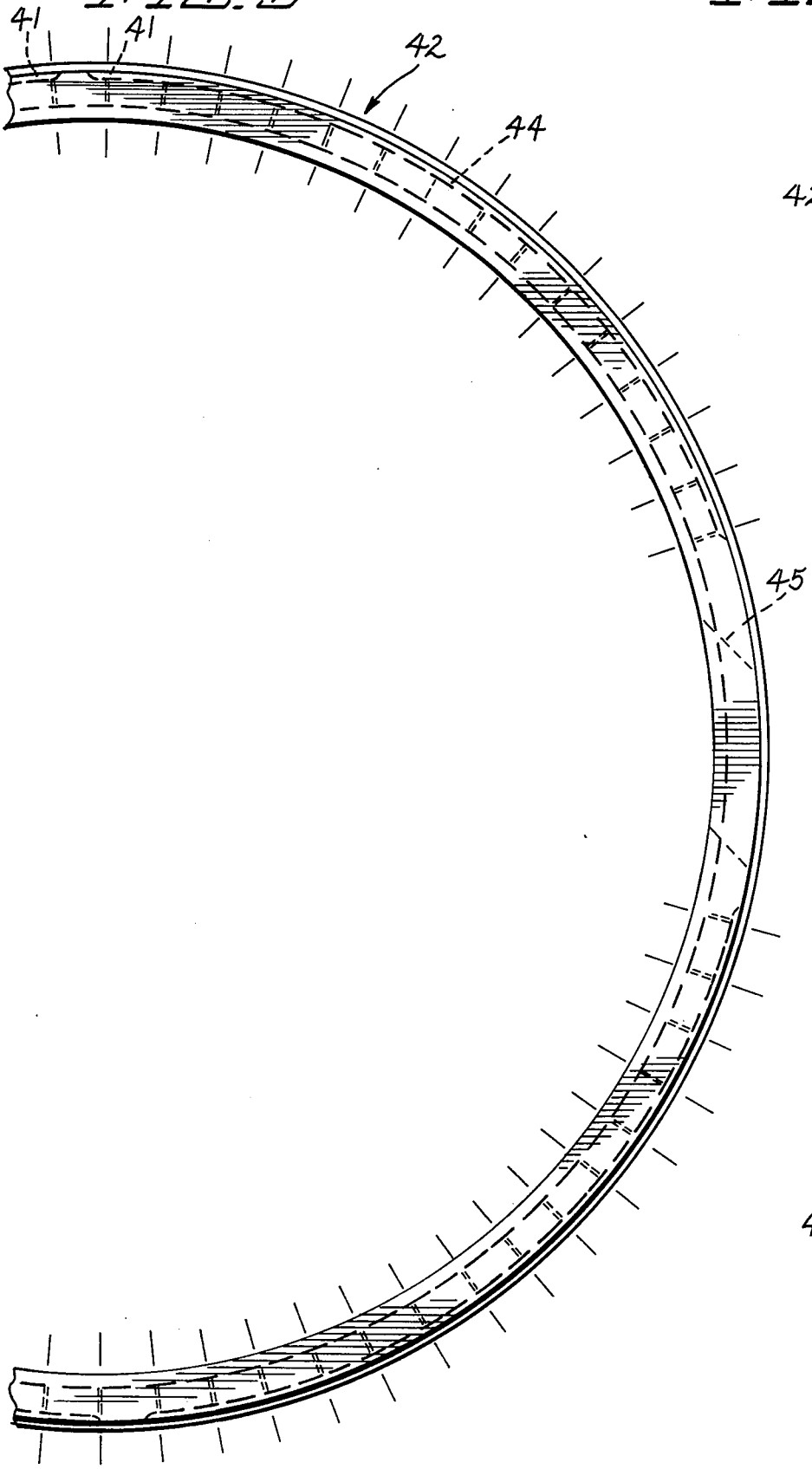
FIG. 3 is a fragmentary elevation of a gas flow control ring on an enlarged scale.
Figure 4:
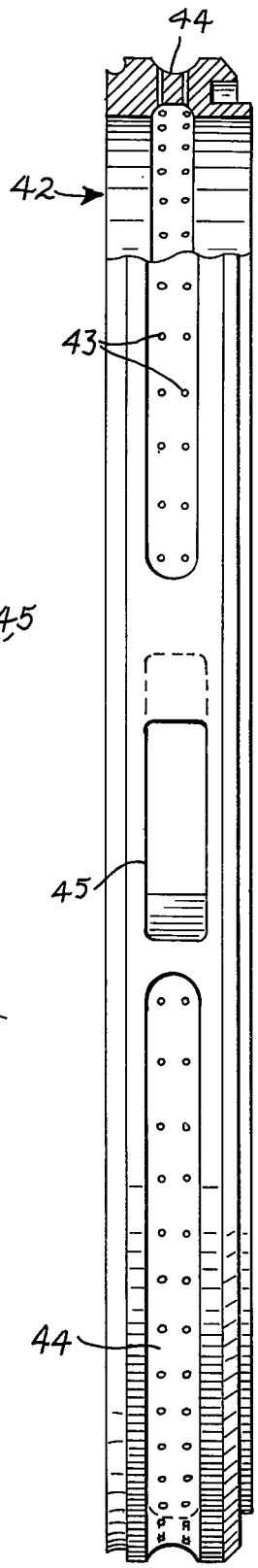
FIG. 4 is an end elevation, partly in section, of the gas flow ring.

Turning now to the improvement of the present invention, there is shown a gas flow control ring, in the form of a gas jet ring, indicated generally at 42, which is disposed around the inside periphery of housing 10 in the classification zone adjacent to the peripheral edge of classifier disc 24. As best seen in FIGS. 2, 3 and 4, gas jet ring 42 is provided with a plurality of closely spaced jet apertures 43. The outer perimeter of ring 42 is provided with a groove or channel 44 which serves as a gas distribution duct to the apertures 43 which extend through the ring in direct gas flow communication with channel 44. Preferably the gas jet apertures are arrayed in parallel rows, as shown. Ring 42 is provided with suitable apertures or ports 45 so located as to be adjacent to tailings port 29 and contaminant take-out port 31.

Preferably channels 44 are provided as a series of a plurality of spaced apart segments disposed end to end around the outer periphery of the ring 42, as best shown in FIGS. 3 and 4. An end 41 of one segment and the adjacent end 41 of another segment is illustrated in FIG. 3. A plurality of gas inlet apertures are provided in housing 10 and fitted with connections 46 to suitable sources of gas under pressure. Desirably the gas duct 44 has four segments, each supplying air to a quadrant for variable control of gas pressure applied to any or all of the quadrants.

Figure 5:
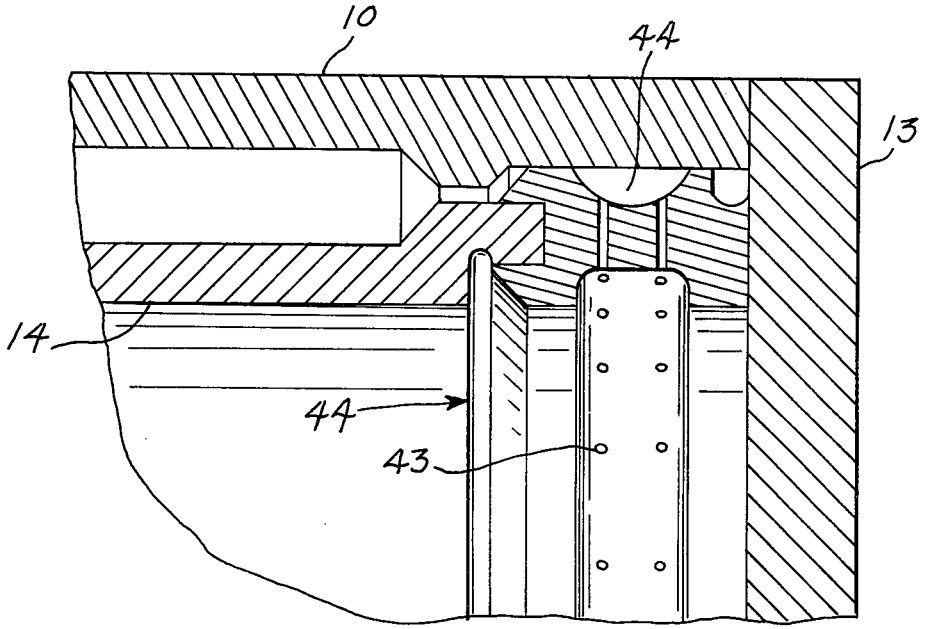
FIG. 5 is a fragmentary section on a further enlarged scale showing the manner of installation of the gas flow ring within the apparatus housing.

In some forms of pulverizing and classifying apparatus, the replaceable liner 14 is held in place by a retainer ring adjacent the discharge side of the housing. In this type of apparatus, as illustrated, and best seen in FIG. 5, the liner retaining ring is replaced by a modified retainer ring according to this invention provided with gas jet apertures and gas distribution ducts. The gas distribution ducts are defined between the outer periphery of the retainer ring and inner periphery of the apparatus housing.

Although the form of gas flow control ring illustrated and described uses gas jets in the form of apertures 43, other means of gas distribution may be used. For example, the ring of jet apertures may be replaced by a ring of porous metal or rigid synthetic resinous plastic material, such as sintered metal, metal or plastic sponge, metal or plastic screening, or the like. Such alternative materials are arrayed with respect to grooves or channels 44 in the same manner as the gas jets 43.

Figure 6:
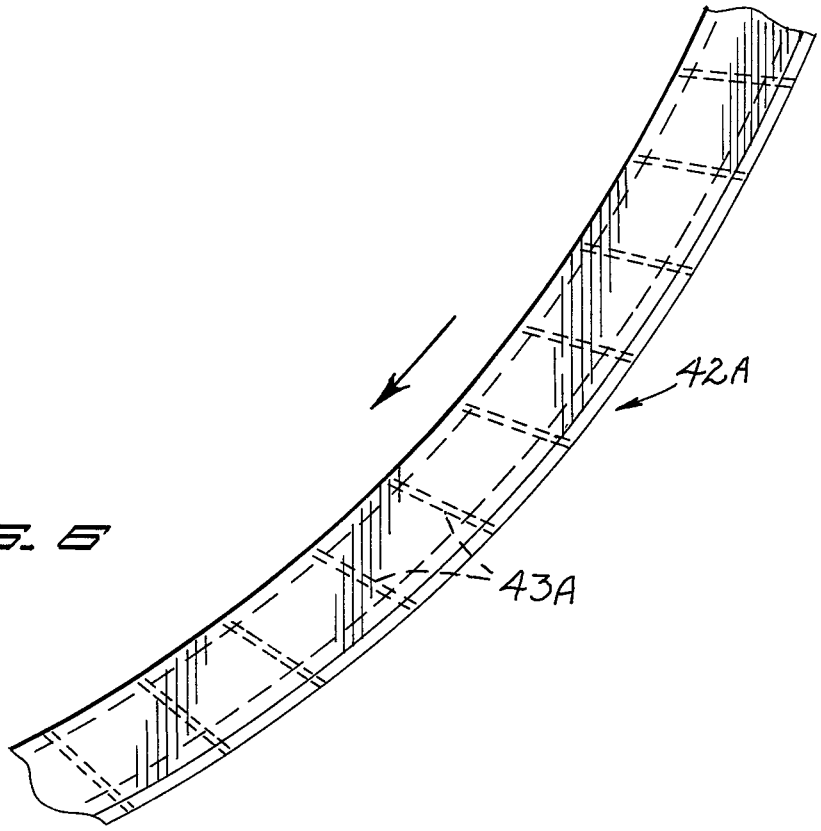
FIG. 6 is a fragmentary elevation of one alternative form of gas flow ring.

In FIG. 6 there is shown an alternative form of gas flow ring 42A including jet apertures 43A, which are back angled from radial. When back angled, preferably apertures 43A are disposed at an angle between about 10° to 20° from the radius of the ring (i.e. 15°), in the direction of rotor travel. This form of construction insures against collection of particles in the apertures and possible clogging during periods of operation when there is no outflow of gas from the jets.

Although the gas flow ring is shown with gas apertures around its entire inner periphery, divided into quadrants, all of these apertures are not used all of the time. Gas flow may be confined to a single ring segment, or to a pair of spaced apart ring segments. Each such segment may be greater or less than a quadrant. In the case of apparatus used to reduce and classify but a single material, the apparatus may be built with gas flow apertures only in the segment or segments where air flow is required for that particular material.

In a typical operation of an apparatus of the type described, the material to be ground consists of particles of varying sizes and weights. The forces applied to the material in the apparatus are known to stratify the material—that is, larger and heavier pieces will tend to congregate adjacent the inner wall while the lighter pieces will be spaced inwardly. Such conditions, for example, will characterize the operation of the apparatus disclosed in the aforementioned U.S. Pat. No. 3,038,672.

As the material progresses toward the discharge aperture 26, it encounters the apertures 29 and 31 defined by the housing 10. Since the material is stratified, amounts of the heavier and larger particles will pass through these apertures. The proportion of material passing through a particular aperture will depend upon the size of the aperture.

The gas streams issuing from ring 42 serve as means for classifying the material, and in particular, the ring 42 functions to insure a more definite stratification of the material. Thus, the gas streams issuing from the ring will necessarily force the lighter particles away from the ring surface while these streams will have less effect on the larger and heavier particles. It will be appreciated that the pressure maintained in a particular segment will determine the magnitude of the forces applied, and the pressure thus provides a control function.

The basic pulverizing and classifying apparatus modified in accordance with this invention was tested under a variety of operating conditions. The test material was limestone known to contain about 1 to 2 percent of alumina and magnesia scale picked up in the limestone from kiln driers. Pressure in the lower left hand quadrant of the gas jet ring (as viewed in FIG. 1) immediately upstream from the tailings aperture 29 varied from 10 to 60 pounds. Gas pressure in the upper right hand quadrant of the gas jet ring just preceding the take-out aperture 31 varied from 20 to 60 pounds. It will be appreciated that the pressure in these two quadrants is of most significance since the nature of the stratified layer as it approaches one of the apertures will determine the nature of the particles which pass through the apertures.

From the tests, it was determined that grinding the product to a finer size can be accomplished more easily when the take-out device 32 is used as compared to when it is not used. Over long periods of time, this means increased capacity and reduced wear. Use of the take-out device results in improved product color. The reduced limestone product is very white whereas the material removed by the take-out device is grey in color. When the take-out device is not used, the product is less white. Application of higher air pressures in the lower left hand quadrant of the gas jet ring results in recycling of lesser amounts of tailings whereas lower air pressure in this zone results in an increased flow of tailings out through aperture 29. Higher air pressure in the upper right hand quadrant results in reduced take-out of abrasive particles and lower pressure results in increased take-out. By proper adjustment of air pressure for various materials, the composition of tailings to be recycled can readily be controlled. All of the coarse over-sized particles are separated for regrinding with a minimum of fine particles recycled.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. In a pulverizing and classifying apparatus for particulate material comprising a cylindrical housing having material inlet and material discharge means at opposite ends, rotary horizontal axis pulverizing means within the housing adjacent the inlet end, coaxial rotary classifying means within the housing adjacent the discharge end, and port means adjacent said classifying means for withdrawing tailings of said material for recycling, the improvement comprising at least one gas supplying chamber, a plurality of gas flow passages defined between said chamber and the interior of said housing, said passages being closely spaced and located in a narrow band around at least part of the inner periphery of said apparatus housing adjacent the classifying means, and at least one gas supply means communicating with said chamber for directing gas under pressure through said passages and into contact with said material, said part of the inner periphery being located immediately upstream of said port means, said gas operating to stratify said material whereby substantial amounts of the larger and heavier portions of the material comprise said tailings.

2. An apparatus according to claim 1 further characterized in that a plurality of said chambers are defined at spaced locations around the inner periphery of the apparatus housing, and a separate gas supply means provided for each of said chambers.

3. An apparatus according to claim 2 further characterized in that said chambers are four in number.

4. An apparatus according to claim 1 further characterized in that said passages are jet apertures disposed in parallel rows extending around the periphery of the apparatus housing, adjacent jet apertures in adjacent rows communicating with the same gas chamber.

5. An apparatus according to claim 1 further characterized in that said passages are in a ring of material selected from the class consisting of sintered metal, metal sponge, synthetic resinous sponge, metal screening and synthetic resinous screening.

6. An apparatus according to claim 1 further characterized in that:

(a) said apparatus includes a contaminant take-out aperture in said housing wall positioned adjacent said classifying means and spaced peripherally substantially from said tailings port, and (b) said passages are provided in at least that portion of the periphery of the apparatus housing adjacent to and upstream from the take-out aperture.

7. An apparatus according to claim 2 characterized by a ring positioned within the housing, said chambers being defined between said ring and said housing, said chambers each being defined by a separate groove in the portion of the ring immediately adjacent the housing.

8. An apparatus according to claim 7 further characterized in that the opposite side of said ring defines a groove, said passages exiting into said groove on said opposite side.

* * * * *